US008956076B2

(12) United States Patent
Menzenbach et al.

(10) Patent No.: US 8,956,076 B2
(45) Date of Patent: Feb. 17, 2015

(54) METHOD FOR THE TREATMENT OF LAYERS, AS WELL AS CONSTRUCTION MACHINE, IN PARTICULAR SOIL STABILIZER OR RECYCLER

(71) Applicant: Wirtgen GmbH, Windhagen (DE)

(72) Inventors: Christoph Menzenbach, Neustadt/Wied (DE); Marc Ridder, Vettelschoss (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/080,838

(22) Filed: Nov. 15, 2013

(65) Prior Publication Data

US 2014/0147206 A1 May 29, 2014

(30) Foreign Application Priority Data

Nov. 27, 2012 (DE) ..... 10 2012 221 654

(51) Int. Cl.
*E01C 21/00* (2006.01)
*E01C 23/06* (2006.01)

(52) U.S. Cl.
CPC ..... *E01C 21/00* (2013.01); *E01C 23/065* (2013.01)
USPC ..... 404/84.5; 404/111; 299/1.5

(58) Field of Classification Search
CPC ..... E01C 23/088; E01C 23/065; E01C 21/00
USPC ..... 404/72, 75–77, 84.05–84.5, 94, 111; 299/1.5–1.9, 39.1–39.4, 81.1
See application file for complete search history.

(56) References Cited

U.S. PATENT DOCUMENTS 4,637,753 A * 1/1987 Swisher, Jr. ..... 404/90
5,544,971 A * 8/1996 Huege et al. ..... 404/72

(Continued)

FOREIGN PATENT DOCUMENTS

DE 20311537 U1 12/2003
DE 102010014904 A1 10/2011

(Continued)

OTHER PUBLICATIONS

European Search Report in corresponding European Application EP 13189033, dated Feb. 11, 2014, 4 pp.

*Primary Examiner* — Raymond W Addie
(74) *Attorney, Agent, or Firm* — Waddey & Patterson, P.C.; Lucian Wayne Beavers

(57) ABSTRACT

In a method and a device for the treatment of a layer by introducing a binder and/or water and/or additives into a milled-up quantity of milled material of the layer to be stabilized by means of a construction machine or attachment machine with a milling/mixing rotor that is used to mill the layer at a specified milling depth, where the milling/mixing rotor is surrounded by a rotor housing which forms the boundary of the mixing chamber of the milling/mixing rotor, it is provided that during the positioning process, at least the binder quantity currently fed until reaching the specified milling depth is determined in accordance with the milled-up quantity of milled material currently present in the mixing chamber.

29 Claims, 3 Drawing Sheets

(56) References Cited

U.S. PATENT DOCUMENTS

| | | | | |
|---|---|---|---|---|
| 6,565,281 | B2 | 5/2003 | Bruns et al. | |
| 6,623,207 | B2 | 9/2003 | Grubba et al. | |
| 7,544,011 | B2 * | 6/2009 | Hall et al. | 404/111 |
| 7,984,963 | B2 * | 7/2011 | Karppinen et al. | 347/35 |
| 2004/0086335 | A1 * | 5/2004 | Thomas et al. | 404/17 |
| 2011/0274491 | A1 * | 11/2011 | Heusinger et al. | 404/91 |
| 2012/0043401 | A1 | 2/2012 | Heusinger et al. | |

FOREIGN PATENT DOCUMENTS

| | | | |
|---|---|---|---|
| EP | 0960239 | A1 | 12/1999 |
| EP | 1073798 | B1 | 2/2003 |
| WO | 02101149 | A1 | 12/2002 |

* cited by examiner

METHOD FOR THE TREATMENT OF LAYERS, AS WELL AS CONSTRUCTION MACHINE, IN PARTICULAR SOIL STABILIZER OR RECYCLER

BACKGROUND OF THE INVENTION

1. Field of the Invention

The invention relates to a method for the treatment of layers, as well as a construction machine or attachment machine, in particular a soil stabilizer or recycler.

2. Description of the Prior Art

With regard to the aforementioned, layers are taken to mean asphalt layers, such as the surface course or base course of a traffic area, granular layers of rock and soils.

Such construction machines are required for the processing of materials, namely, for example, the stabilization of soils of insufficient load-bearing capacity, the pulverization of asphalt pavements and the recycling or stabilization, respectively of bound or unbound layers.

Known stabilizers or recyclers comprise a rotor housing in which a milling/mixing rotor is arranged, as well as a unit for discharging and metering binders for soil stabilization.

The milling/mixing rotor revolving in a mixing chamber is generally arranged in a height-adjustable and slope-adjustable fashion for adaptation to the surface to be worked.

The required processes, such as the stripping away and crushing of the milled-up layers, the addition of binders, the mixing and homogenization of added materials etc., take place in said mixing chamber in accordance with the current application.

Such machines are frequently used for soil stabilization.

For the improvement or stabilization of soils, it is known to introduce pulverized binders such as lime or cement, water and/or additives into the soil to increase the suitability for placing and load-bearing capacity of said soils. Typical applications for soil stabilization are the construction of roads or railway lines as well as industrial areas.

Cement can also be added as slurry (dissolved in water) for dust-free addition. This method is only applicable, however, if additional water is to be introduced into the soil. This method is not suitable for soils that already have an excessively high water content. In addition, foamed bitumen, bituminous solutions or additives are used to increase the load-bearing capacity of soils.

To bind loose soil layers, it is therefore common practice for these binders, such as bituminous solutions, foamed bitumen or slurries, and/or additives and/or water to be mixed with the milled-up material in the stabilizing process.

In the process, the quantity of binder to be mixed in results from site-specific requirements and is generally indicated in percent by weight relative to the milled material to be treated (for example, 1% of binder added equals 10 kg of binder per t of milled material).

According to prior art, metering of the binders is effected by means of a metering device which adjusts the actual quantity of binder introduced to the current operational mode of the machine. To this end, the milled material quantity of the material milled up per unit of time is measured during the operation based on the milling width, milling depth and advance speed. Metering of the binder can then be effected on the basis of this value.

Metering of the binder is generally effected in a weight-dependent fashion based on a measurement of the volumetric flow and based on the known density of the binder.

When working several milling cuts extending parallel to one another, it is normal for the milling cuts to overlap. In this case, it is necessary to consider only that portion of the milled-up material that has not yet been mixed with binder as part of the previously effected treatment of a parallel cut.

To this end, the metering width for the binder is adjusted, and determination of the milled-up quantity of milled material that has to be mixed with binder is not effected based on the milling width but based on the adjusted activated metering width.

During the continuous milling and mixing process, an essentially constant milled material quantity of milled-up material is present in the mixing chamber so that the quantity flow (mass or volumetric flow) only is considered with respect to metering.

It is therefore sufficient in accordance with prior art to measure the advance speed provided that the milling depth and metering width remain constant. At a constant advance speed, the quantity flow in the mixing chamber inside the rotor housing remains constant.

It is of disadvantage in the prior art, however, that no proportionally metered mixing in of the binder can be effected for the positioning process of the milling/mixing rotor at the start of the working process.

The pumps used for conveying the binder in accordance with prior art cannot be adjusted from a zero value to a desired delivery rate. As a general rule, it is therefore not possible to continuously increase the delivery quantity during the positioning process.

If injection begins as early as the start of the positioning process, the quantity of binder introduced is too high and the working result will therefore not meet the specified requirements.

If injection of the binder only begins when the milling rotor has fully penetrated the layer to be worked or when the machine begins its forward movement, respectively, the problem arises that material already removed is already outside the range of engagement of the milling/mixing rotor and can thus no longer be mixed with the binder now being injected.

In practical use, there is thus a positioning area of several metres at the start of a milling cut in which the material is not mixed with a sufficient binder quantity or in which an excessive binder quantity is introduced into the material. This area must then be reworked by other means. Alternatively, it is possible to deactivate the automatic during the positioning process and to manually control the introduction of the binder. It is of disadvantage in this design, however, that metering of the material is not effected in accordance with the specified requirements, too much or too little binder is usually introduced into the soil and the quality of the worked area does not meet the specified requirements as no uniform stability of the worked layer is achieved across the entire worked area.

This is of disadvantage in particular because more than one positioning process is usually required for working an area, and reworking of the work results is therefore required in several places. If reworking is omitted, there is an increasing risk of damages, and a reduced durability of the traffic area is to be expected.

SUMMARY OF THE INVENTION

It is therefore the object of the invention to create a method for stabilizing layers, or a construction machine, respectively that make it possible to avoid the necessity of reworking the work result.

The invention advantageously provides that, during the positioning process, at least the binder quantity to be currently fed until reaching the specified milling depth is essentially determined in accordance with the milled-up quantity of milled material currently present in the mixing chamber. This offers the advantage that the specified mixing ratio between binder and milled-off material can essentially also be met during the positioning phase and that homogeneous soil stabilization can be achieved across the entire worked area.

With regard to the aforementioned, the term binder is taken to mean binders as well as water and/or additives.

It may be provided that the quantity of milled material currently present in the mixing chamber is, as a minimum, determined in accordance with the current milling depth of the milling/mixing rotor.

Preferably, the quantity of milled material currently present in the mixing chamber is, as a minimum, determined in accordance with the current penetration speed of the milling/mixing rotor into the layer.

The invention provides for the change in the milling depth to be measured in order to infer the changing quantity of milled material in the mixing chamber.

It has to be assumed that a constant penetration speed for penetration of the milling and mixing rotor into the material is very rarely given during the positioning process at the beginning of the milling and mixing process. The reason for this is that, for example, different asphalt layers have different strengths, for example, a surface course vis-à-vis a base course.

In particular, it is provided for the milled-up quantity of milled material present in the mixing chamber to be determined by measuring the milling depth, as well as in accordance with the radius and width of the milling/mixing rotor or the metering width, respectively.

The metering width of the milling/mixing rotor is that part which is engaged with the as yet untreated layer. A metering device, for example, in the design of a metering bar with several injection nozzles arranged next to one another, is switched on in the area of the metering width only.

The change in the binder quantity to be currently fed can be calculated from the change in the milling depth.

To this end, the quantity of milled material currently milled per unit of time is essentially calculated during penetration of the milling/mixing rotor into the layer by means of detecting the change in the milling depth. This enables the quantity of milled material as yet not mixed with binder to be determined in accordance with the radius of the cutting circle and the milling width or the current metering width of the milling/mixing rotor respectively. The quantity of binder injected into the mixing chamber is then controlled based on the quantity of milled material per unit of time currently present in the mixing chamber which has been determined by this method.

The change in the milling depth is caused by the penetration speed. The quantity of milled material currently present in the mixing chamber is calculated based on the milling depth. At any given point in time, the integrated quantity of binder fed has to be proportionate to the integrated quantity of milled material present in the mixing chamber.

One embodiment provides for the injection of binder to be started when the quantity of milled material exceeds a certain limit, or for a continuous injection of a variable quantity flow of binder to be started when a sufficient quantity of milled material is present in the mixing chamber.

The milling depth can be determined at a certain point in time based on the penetration speed; the volume present in the mixing chamber at a certain point in time can be correlated with said milling depth based on the specified geometry of the milling rotor.

Alternatively, the current milling depth may also be measured directly.

After reaching the specified milling depth and commencement of the advance movement, control of the quantity flow of binder can be effected in the conventional way in accordance with the milling width, the specified milling depth and the current advance speed using the method known from prior art.

The above object is also achieved by a construction machine in which the control device controls the currently fed binder quantity prior to reaching the specified milling depth in accordance with the quantity of milled material currently present in the mixing chamber.

It is preferably provided for the control device to determine the quantity of milled material currently present in the mixing chamber, as a minimum, in accordance with the penetration speed of the milling/mixing rotor into the ground layer and to proportionally control metering of the binder.

A preferred embodiment provides for the density values of different layers to be worked off and the binders to be used to be saved in a data base of the control system or control device.

In the following, the invention is explained in more detail with reference to the figure.

BRIEF DESCRIPTION OF THE DRAWINGS

The following is shown.

DETAILED DESCRIPTION

Figure 1:
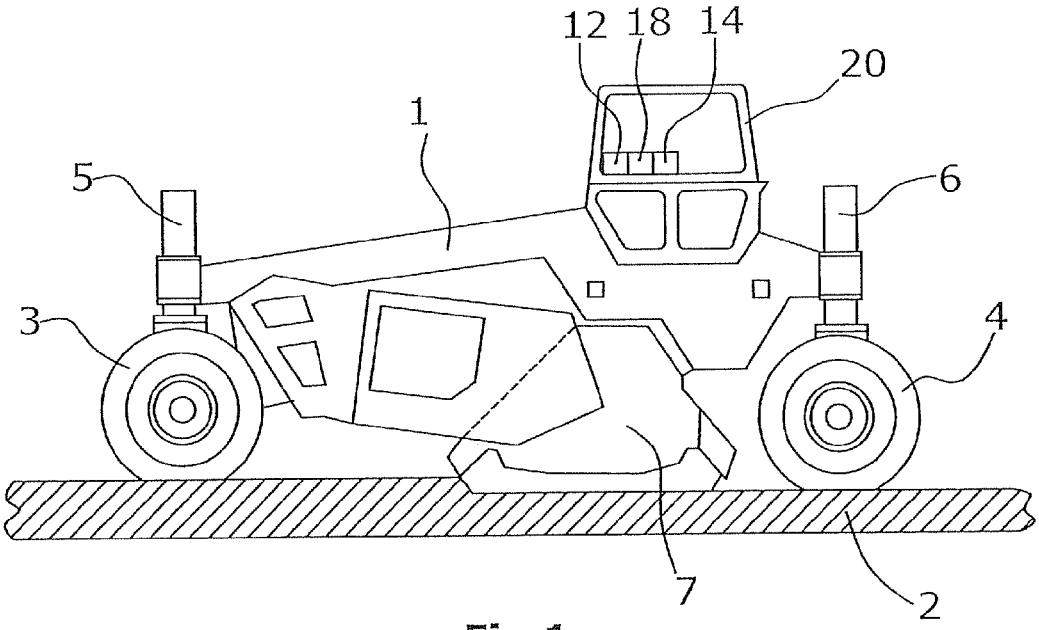
FIG. 1 a schematic representation of a construction machine according to the invention, FIG. 2 the mixing chamber surrounding the milling and mixing rotor with a metering device for the injection of binder, FIG. 3*a* positioning areas resulting from the positioning process, FIG. 3*b* the stability of the stabilized layer of soil in accordance with prior art, FIG. 4*a* a schematic representation of the calculation parameters for determination of the binder quantity, FIG. 4*b* the milling width of the milling/mixing rotor, and FIG. 5 the adjustment of binder metering during the positioning phase in comparison with prior art.

FIG. 1 shows a schematic representation of the principal components of an automotive stabilizer or recycler. The construction machine comprises a machine frame 1 supported by a chassis. The chassis comprises two each front wheels 4 as seen in the working direction 9 and two rear wheels 3 as seen in the working direction, said wheels being attached to front and rear lifting columns 6,5. The front and rear lifting columns 6,5, which can each be operated independently of one another, are in turn attached to the machine frame 1 so that the machine frame can be adjusted in height vis-à-vis the ground layer 2. Ground-engaging units, for example, tracked ground-engaging units, may be provided in lieu of the wheels 3,4.

FIG. 1 depicts the machine for the working of roadways with a machine frame 1 supported by a chassis and an operator's platform consisting of a driver's cabin 20.

The suspensions comprise two jointly or optionally separately steerable suspension axles at the front and rear ends of the machine frame 1, where each wheel is provided with an own hydraulic drive in the design of a hydraulic motor and can be driven separately, should the need arise. Each wheel is provided with a height adjustment device 5,6 enabling the height of the machine frame 1 and, should the need arise, its inclination to be precisely adjustable to the working height or transport height. Below the driver's cabin 20 towards the machine's centre, a rotor housing 7 is attached in an offset fashion which forms the boundary of a working chamber of a rotating milling/mixing rotor 8 serving as a mixing chamber 10.

Figure 2:
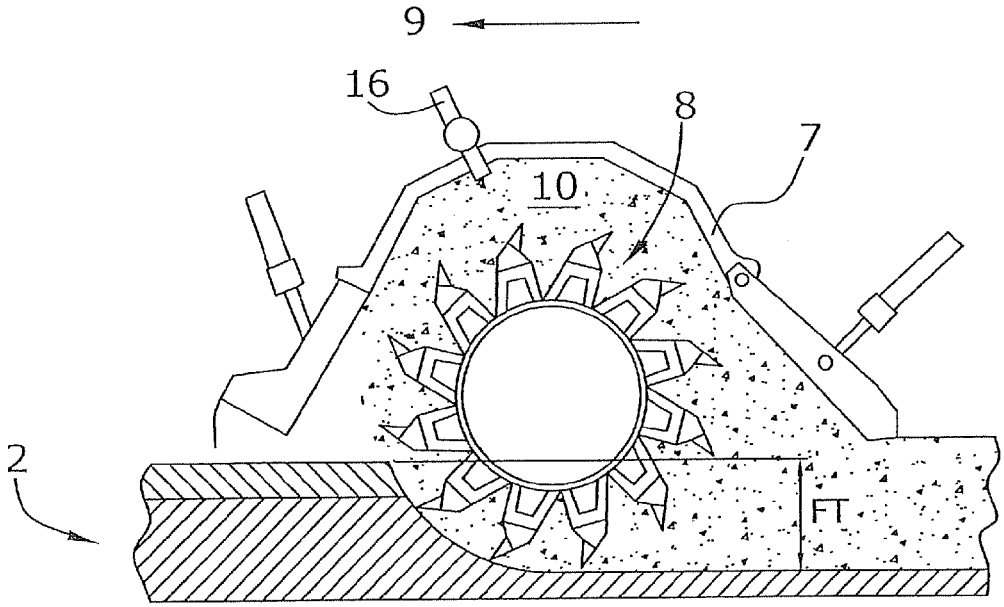

FIG. 2 shows a schematic illustration of the milling/mixing rotor 8 with the mixing chamber 10 surrounding it below the rotor housing 7. In FIG. 2, the milling/mixing rotor 8 is depicted in continuous operation in which metering of the binder by means of a metering device 16 is carried out in the conventional way, that is, in accordance with the advance speed. The situation is therefore depicted in which the milling/mixing rotor 8 has already reached the specified milling depth FT.

Figure 3A:
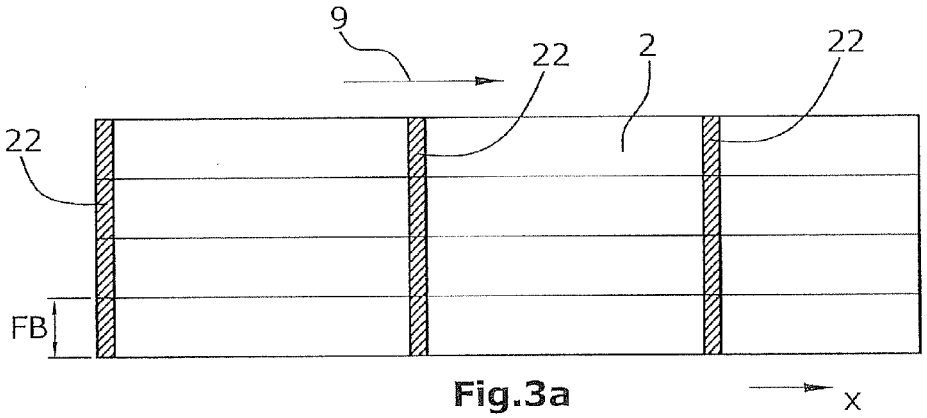

FIG. 3*a* shows a top view of an area to be worked in which the construction machine has worked the layer 2 in several parallel milling cuts arranged next to one another because the milling width FB of the milling/mixing rotor 8 is smaller than the width of the area to be worked. This process results in several positioning areas 22 both in the working direction 9 and transverse to the same in which the milling/mixing rotor 8 has been lowered from its idle position to the desired milling depth FT.

Figure 3B:
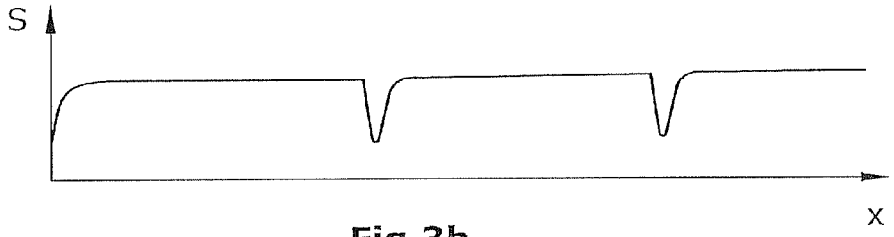

If no control of the binder quantity is effected in the positioning area 22, the prior art results in differences in the stability S of the subsoil as they are shown in FIG. 3*b* in accordance with the distance x shown in FIG. 3*a*. When loaded with high dynamic weights, such as heavy goods vehicle traffic, these weak spots at the positioning areas 22 can lead to the stabilized surface being damaged or the durability being reduced significantly.

When working large areas, different boundary conditions usually require the machine to be repositioned several times.

In addition to the fact that repeated positioning is required because of the limited working width of the construction machine, for example, a stabilizer, it may become necessary to interrupt a milling cut and work neighbouring adjacent areas to enable reworking by graders and/or compactors.

This is mainly due to the fact that, after introduction of the binder, there is only a limited period of time available for the material to be worked in the desired quality.

This is due, among other things, to the fact that the binders introduced may evaporate or harden.

Figure 4A:
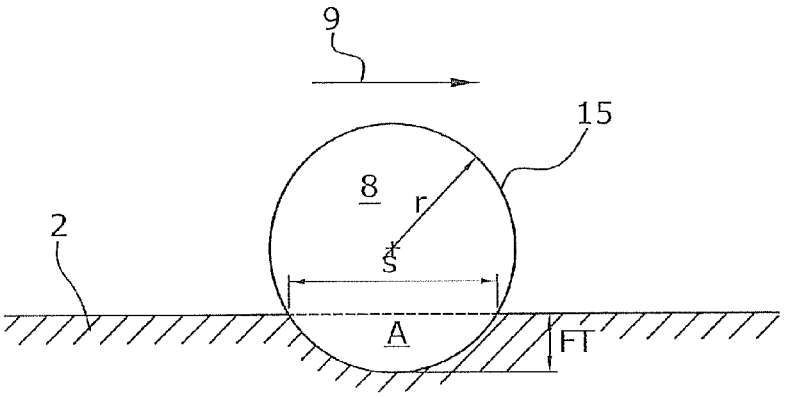

FIG. 4*a* shows the cutting circle 15 with the radius r of the milling/mixing rotor 8 during the positioning process in which the milling/mixing rotor 8 is initially lowered to the specified milling depth FT. During the positioning process, there is preferably no movement yet of the construction machine in the direction of advance 9.

There is, however, the possibility of the lowering movement to be superimposed with a forward advance movement. In such an event, calculation of the quantity of milled material present in the mixing chamber 10 must include the quantity of milled material per unit of time that additionally enters the mixing chamber 10 on account of the advance speed.

A complex situation arises during the positioning process as the calculation of the milled-up quantity of milled material must now be effected via a function taking into account the milling rotor width FB (or a metering width FB' respectively) and the cross-sectional area A of that part of the cutting circle 15 of the milling/mixing rotor 8 that is engaged with the layer 2.

A designates the cross-sectional area of the circular segment currently present in the layer 2, said circular segment being specified by the milling depth FT and the diameter of the milling/mixing rotor 8, that is, the radius r of the cutting circle 15.

A change in the milling depth FT therefore simultaneously results in a change of the cross-sectional area A over time. The volume can be calculated from the product of milling width FB (or metering width FB' respectively) and the cross-sectional area A.

The following relations apply:

$$A = \frac{FT}{6s} * (3FT^2 + 4s^2)$$

$$r = \frac{FT}{2} + \left(\frac{s^2}{8 * FT}\right)$$

Solving the lower relation for S results in:

$$s = \sqrt{8 * FT * r - 4 * FT^2}$$

For the current cross-sectional area A, insertion of s into the upper relation results in:

$$A = \frac{32 * FT^2 * r - 13 * FT^3}{6 * \sqrt{8 * FT * r - 4 * FT^2}}$$

It is understood that the formulae specified merely represent a realizable embodiment not limiting the scope of the patent, and that it is possible to alter the formulae, for instance, in the form of correction factors or additional parameters or simplifications.

The change in the cross-sectional area A at a constant or non-constant lowering speed of the milling/mixing rotor 8 therefore results in a continuous change in the volume or the mass, respectively of the milled-up milled material per unit of time.

It follows from the above that even at a constant penetration speed of the milling/mixing rotor into the material, binder metering is not constant and must be continuously adjusted in accordance with the milling depth.

Figure 5:
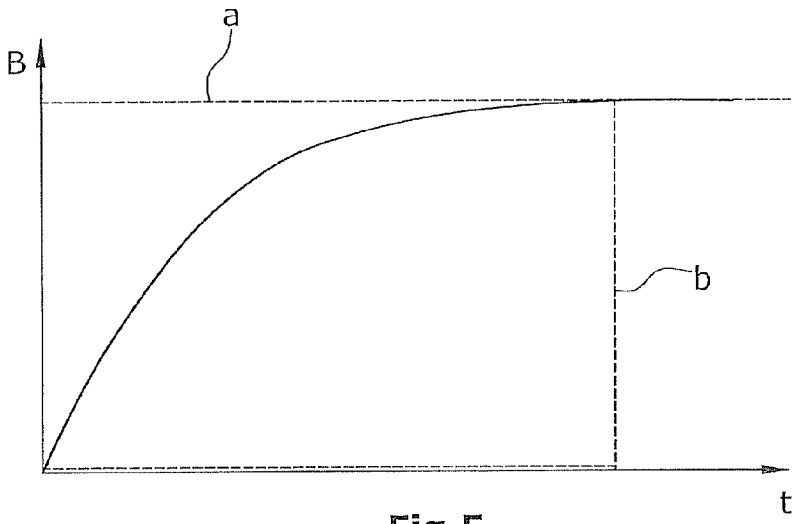

FIG. 5 shows a simplified example of variable binder metering B=f (t) during the positioning process in comparison to metering in accordance with prior art in which in one case (a) injection is effected as early as the beginning or in the other case (b) at the end of the positioning process.

Calculation of the mass of binders to be added per unit of time is effected in accordance with the mass M of the quantity of milled material per unit of time by means of the following relation:

$$(M/t) = (V/t) * D,$$

where V/t indicates the milled-up volume per unit of time and D indicates the density of the milled material.

After reaching the specified milling depth FT, the volume per unit of time V/t of the milled-up quantity of milled material results from the cross-sectional area of the milling/mixing rotor 8 that is engaged with the material layer 2, and the distance/time traveled (advance speed v) from the following relation in accordance with prior art:

$$(V/t) = FT * FB * v.$$

The metering device 16, by means of which the binder is fed, is controlled by a control device 14. The control device 14 may be a component of a machine control system 12 which is used to control the traction drive of the construction machine and the drive of the milling/mixing rotor 8.

The density values D of different layers 2 to be worked off and of the binders to be used are preferably saved in a data base 18 of the control system 12 or the control device 14.

Figure 4B:
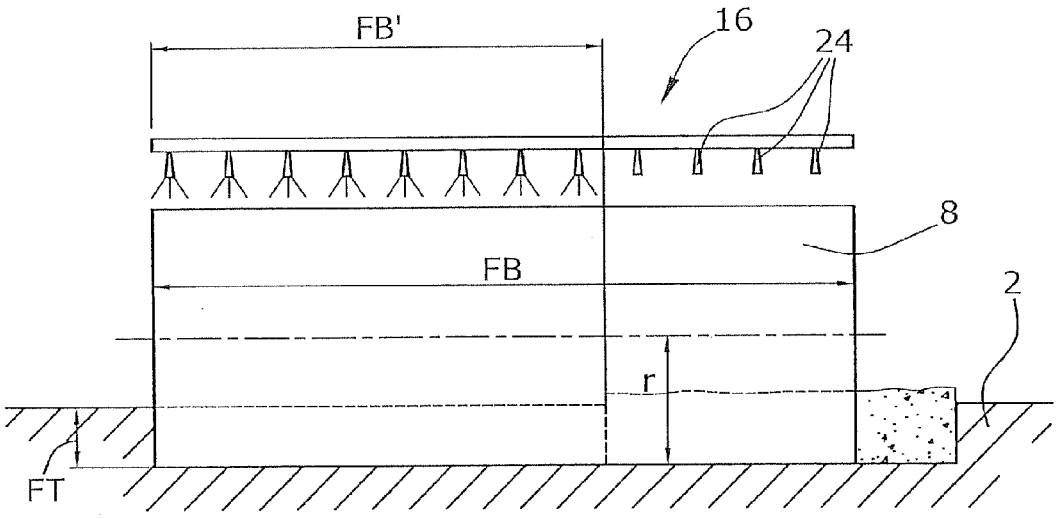

As can be inferred from FIG. 4*b*, it may happen that the milling/mixing rotor 8 overlaps with a previously milled-up milling cut so that the milling/mixing rotor 8 is only partially engaged with an as yet untreated layer 2. In this case, not all of the injection nozzles 24 of the metering device 16 are activated but only those injection nozzles 24 that are within the active metering width FB' of the milling/mixing rotor 8. Taking into account the active metering width FB' allows correct metering of the binder even in the event of overlapping milling cuts.

In the formulae, the milling width FB may be replaced with the effective metering width FB' in order to correctly calculate the binder quantity.

In the simplest embodiment, it is only necessary to measure the milling depth FT during the positioning process and to determine the volume and thus the mass of the milled material based on the milling depth. When a certain quantity of milled material has been reached, binder is injected accordingly.

To ensure that the pumps used for conveyance of the binder operate in accordance with the pump-specific operating parameters, it may also be necessary to this end to introduce the binder into the mixing chamber 10 not continuously but in a clocked fashion. To this end, the quantity of milled material present in the milling rotor housing 7 is monitored continuously in order to determine as to when a renewed introduction of binder is required.

EXAMPLE

It is necessary to admix 10% by weight of binder. Upon activation, the pump exhibits a minimum delivery quantity of binder of a volume corresponding to 20 kg.

A first injection of the minimum quantity of binder is effected as soon as the quantity of milled material (determined via the milling depth) corresponds to a mass of 200 kg. A second injection of the minimum quantity of binder is effected as soon as the quantity of milled material corresponds to a milled-up mass of 400 kg etc. This course of action enables the entire positioning process to be accompanied without having to detect the penetration speed.

As soon as a sufficient quantity flow of material has been reached to ensure operation of the pumps above the minimum delivery quantity, continuous injection of binders at a variable quantity flow can begin.

When the machine begins its advance movement, continuous introduction of the binder in accordance with the advance speed v can be effected as per the method known from prior art.

In lieu of an automotive stabilizer, attachment stabilizers may also use the method described herein. These are non-automotive attachment machines moved, for example, by a tractor. The Wirtgen machine WS 250 is an example of such an attachment stabilizer.

In other applications, metering of the binder, such as slurry, is not effected by the stabilizer itself but, for example, by a preceding slurry mixing plant as it is known, for example, as the Wirtgen slurry mixing plant WM 1000.

For instance, it is possible in this embodiment to effect control of the binder quantity discharged on another machine based on the operating parameters of the soil stabilizer or attachment machine, with the binder being fed into the mixing chamber 10.

What is claimed is:

1. A method for the treatment of layers, comprising:

(a) positioning a milling/mixing rotor into the layers down to a specified milling depth, the milling/mixing rotor being surrounded by a rotor housing forming a boundary of a mixing chamber of the milling/mixing rotor; and (b) during step (a), prior to the milling/mixing rotor reaching the specified milling depth, feeding into the mixing chamber a quantity of binder determined as a function of a milled up quantity of milled material currently present in the mixing chamber.

2. The method of claim 1, wherein:

the quantity of milled material currently present in the mixing chamber is determined as a function of at least a current milling depth of the milling/mixing rotor.

3. The method of claim 2, wherein:

the quantity of milled material currently present in the mixing chamber is determined as a function also of a radius of the milling/mixing rotor and a milling width or metering width of the milling/mixing rotor.

4. The method of claim 1, wherein:

the quantity of milled material currently present in the mixing chamber is determined as a function of at least a penetration speed of the milling mixing rotor into the layers.

5. The method of claim 1, further comprising:

after reaching the specified milling depth, feeding binder into the mixing chamber as a function of the specified milling depth, a current advance speed, and a milling width or metering width of the milling/mixing rotor.

6. The method of claim 1, wherein:

in step (b), the binder is fed into the mixing chamber as a weight percentage of the quantity of milled material currently present in the milling chamber.

7. The method of claim 1, wherein:

in step (b), the binder is intermittently fed into the mixing chamber.

8. The method of claim 1, wherein:

in step (b), the binder includes binder material and water.

9. The method of claim 1, wherein:

in step (b), the binder includes binder material and at least one additive.

10. The method of claim 1, wherein:

in step (b), the milled up quantity of milled material currently present in the mixing chamber excludes previously milled material previously mixed with binder which is currently present in the mixing chamber.

11. A construction machine, comprising:

a machine frame;

front ground engaging units and rear ground engaging units configured to support the machine frame from a ground surface;

a rotor housing connected to the machine frame between the front and rear ground engaging units, the rotor housing forming a boundary of a mixing chamber;

a rotor mounted to rotate within the rotor housing;

at least one metering device configured to meter at least one binder into the mixing chamber; and a control unit operably connected to the at least one metering device and configured to control a quantity of the at least one binder metered into the mixing chamber per unit of time automatically in relation to a quantity of milled material milled up per unit of time, the control unit being also configured to control a quantity of the at least one binder currently metered into the mixing chamber prior to the rotor reaching a specified milling depth as a function of a milled-off quantity of milled material currently present in the mixing chamber.

12. The construction machine of claim 11, wherein:

the control unit is configured to determine the milled off quantity of milled material currently present in the mixing chamber prior to the rotor reaching the specified milling depth as a function of at least a current milling depth of the rotor.

13. The construction machine of claim 11, wherein:

the control unit is configured to determine the milled off quantity of milled material currently present in the mixing chamber prior to the rotor reaching the specified milling depth as a function of at least a penetration speed of the rotor into the ground surface.

14. The construction machine of claim 11, wherein:

the control unit is configured such that upon the rotor reaching the specified milling depth, the quantity of the at least one binder metered into the mixing chamber per unit of time is controlled as a function of the specified milling depth, a currently measured advance speed and a milling width or metering width of the rotor.

15. The construction machine of claim 11, wherein:

the control unit is configured such that the at least one binder is metered into the mixing chamber as a weight percentage of a corresponding quantity of milled material to be mixed with the at least one binder in the mixing chamber.

16. The construction machine of claim 11, wherein:

the control unit includes a data base having density values of different ground layers to be worked off and density values of the at least one binder saved in the data base.

17. The construction machine of claim 11, wherein:

the at least one metering device and the control unit are configured such that the at least one metering device can be operated intermittently.

18. The construction machine of claim 11, wherein:

the at least one binder includes binder material and water.

19. The construction machine of claim 11, wherein:

the at least one binder includes binder material and at least one additive.

20. A construction machine for the treatment of layers by milling up the layers and by introducing binder, the machine comprising:

a machine frame;

a rotor housing connected to the machine frame and forming a boundary of a mixing chamber;

a mixing rotor mounted to rotate inside the rotor housing;

at least one metering device configured to meter at least one binder material into the mixing chamber; and a control unit operably associated with the at least one metering device, wherein:

the control unit is configured to control quantities of the at least one binder material, water and additive metered into the mixing chamber per unit of time automatically in relation to a quantity of milled material milled up per unit of time; and the control unit is configured such that as the mixing rotor is being lowered into the layers and prior to the mixing rotor reaching a specified milling depth, the control unit controls a quantity of the at least one binder material, water and additive currently metered into the mixing chamber as a function of a quantity of milled material currently present in the mixing chamber.

21. The construction machine of claim 20, wherein:

the control unit is configured to determine the milled off quantity of milled material currently present in the mixing chamber prior to the mixing rotor reaching the specified milling depth as a function of at least a current milling depth of the mixing rotor.

22. The construction machine of claim 20, wherein:

the control unit is configured to determine the milled off quantity of milled material currently present in the mixing chamber prior to the mixing rotor reading the specified milling depth as a function of at least a penetration speed of the mixing rotor into the layers.

23. The construction machine of claim 20, wherein:

the control unit is configured such that upon the mixing rotor reaching the specified milling depth, the quantity of the at least one binder material, water and additive metered into the mixing chamber per unit of time is controlled as a function of the specified milling depth, a currently measured advance speed and a milling width or metering width of the mixing rotor.

24. The construction machine of claim 20, wherein:

the control unit is configured such that the at least one binder material, water and additive is metered into the mixing chamber as a weight percentage of a corresponding quantity of milled material to be mixed with the at least one binder material, water and additive in the mixing chamber.

25. The construction machine of claim 20, wherein:

the control unit includes a data base having density values of different ground layers to be worked off, and density values of the at least one binder material saved in the data base.

26. The construction machine of claim 20, wherein:

the at least one metering device and the control unit are configured such that the at least one metering device can be operated intermittently.

27. The construction machine of claim 20, wherein the construction machine is a soil stabilizer machine.

28. The construction machine of claim 20, wherein the construction machine is a recycler machine.

29. The construction machine of claim 20, wherein the construction machine is an attachment machine configured to be pulled behind a tractor.

* * * * *